United States Patent [19]

Holley, Jr. et al.

[11] 4,364,509

[45] Dec. 21, 1982

[54] ARTICLE CARRIER WITH DISPENSING FEATURE

[75] Inventors: John M. Holley, Jr., Clarkston; James R. Oliff, Austell, both of Ga.

[73] Assignee: The Mead Corporation, Dayton, Ohio

[21] Appl. No.: 277,096

[22] Filed: Jun. 25, 1981

[51] Int. Cl.[3] ..... B65D 5/70; B65D 5/72

[52] U.S. Cl. ..... 229/17 B; 221/303; 206/624

[58] Field of Search ..... 229/17 B, 17 S, 7 R; 206/627, 427, 434, 623, 624; 221/82, 86, 89, 303, 305, 306

[56] References Cited

U.S. PATENT DOCUMENTS

| | | | |
|---|---|---|---|
| 3,540,581 | 11/1970 | Kloonis | 229/17 B |
| 3,894,681 | 7/1975 | Arneson | 229/17 B |
| 4,216,861 | 8/1980 | Oliff | 229/611 |

*Primary Examiner*—Herbert F. Ross

*Attorney, Agent, or Firm*—Rodgers & Rodgers

[57] ABSTRACT

An article carrier comprising a bottom, top and a pair of side walls interconnected to form a tubular carrier, end flaps foldably joined respectively to each end of said walls, web panels interconnecting the ends of adjacent end flaps, a pair of tear lines formed respectively in the adjacent end flaps disposed at the opposite ends of one end flap and extending respectively from one end of the adjacent end flaps to the fold lines between the adjacent end flaps and the associated walls, and a pair of expansion slits extending respectively from the inner ends of the tear lines into the adjacent walls.

4 Claims, 5 Drawing Figures

ARTICLE CARRIER WITH DISPENSING FEATURE

TECHNICAL FIELD

This invention relates to a fully enclosed article carrier with a convenient article dispensing feature.

BACKGROUND ART

Article carriers with a built-in dispensing feature are known in the art. One example is disclosed in U.S. Pat. No. 3,894,681. Historically these carriers have generally proven to be inconvenient and unreliable.

DISCLOSURE OF THE INVENTION

According to this invention in one form an article carrier is provided and comprises interconnected bottom, top and side walls, end flaps joined respectively to the ends of the top, bottom and side walls, a pair of web panels interconnecting respectively the ends of one of the end flaps and the adjacent end flaps, and a pair of tear lines formed respectively in the adjacent end flaps and extending respectively from the junctions between the adjacent end flaps and the associated walls and terminating along the edges of the adjacent end flaps substantially adjacent the web panels.

BEST MODE FOR CARRYING OUT THE INVENTION

Figure 1:
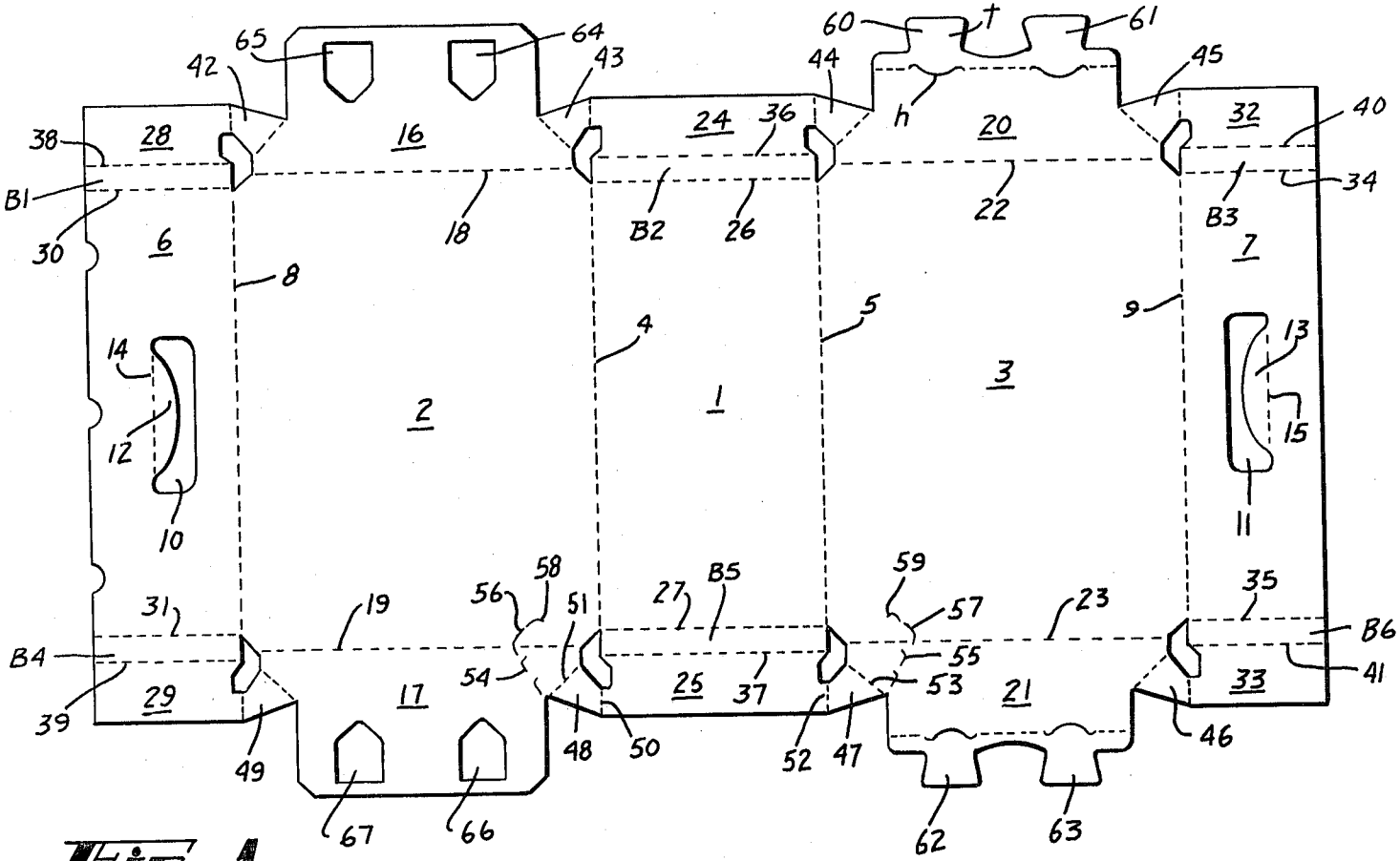
FIG. 1 is a plan view of the blank from which an article carrier is formed according to this invention.

With reference to the drawings and with particular reference to FIG. 1, the numeral 1 designates the bottom wall of the carrier to the side edges of which side walls 2 and 3 are foldably joined respectively along fold lines 4 and 5. The top wall of the carrier is formed by a combination of top panels 6 and 7 which are foldably joined respectively to the upper edges of side walls 2 and 3 along fold lines 8 and 9.

Carrying means is provided for the carrier and is formed by hand carrying apertures 10 and 11 which are struck from top panels 6 and 7 respectively. In addition cushioning flaps 12 and 13 are provided and are foldably joined respectively to top panels 6 and 7 along fold lines 14 and 15.

End closure structure, in part, is provided for the carrier in the form of end flaps 16 and 17 which are foldably joined to the end edges of side wall 2 along fold lines 18 and 19 respectively. In addition, end flaps 20 and 21 are foldably joined respectively to the end edges of side wall 3 along fold lines 22 and 23. In like fashion end flaps 24 and 25 are foldably joined to the end edges of bottom wall 1 along fold lines 26 and 27 respectively.

Additional end closure structure is provided in the form of partial end flaps 28 and 29 which are foldably joined respectively to the end edges of top panel 6 along fold lines 30 and 31. Likewise partial end flaps 32 and 33 are foldably joined respectively to the end edges of top panel 7 along fold lines 34 and 35. Also bend lines 36, 37, 38, 39, 40 and 41 are formed in end flaps 24 and 25 and partial end flaps 28, 29, 32 and 33 respectively and define bevelled corner panels B1–B6. While bevelled corner panels B1–B6 are desirable for many applications of the invention, these may be omitted in some forms of the invention.

Means to interconnect the various end flaps is provided in the form of web panels 42–49. Since the web panels 42–49 are virtually identical, only the specific features of web panels 47 and 48 are discussed in detail. More specifically web panel 48 is foldably joined to end flap 25 along fold line 50 and, likewise, another edge of web panel 48 is foldably joined to end flap 17 along fold line 51. In like fashion, web panel 47 is foldably joined respectively to end flaps 25 and 21 along fold lines 52 and 53. A totally enclosed carrier of the general type to which this invention is applicable is disclosed and claimed in U.S. Pat. No. 4,216,861 issued Aug. 12, 1980 and owned by the assignee of this invention.

According to a feature of this invention, tear lines 54 and 55 are formed respectively in end flaps 17 and 21. Also tear lines 54 and 55 extend respectively from the junctions between side walls 2 and 3 and end flaps 17 and 21 to the end edges of end flaps 17 and 21 at the points of coincidence with the outer ends of fold lines 51 and 53 as viewed in FIG. 1. In addition, expansion slits 56 and 57 extend respectively from the ends of tear lines 54 and 55 remote from web panels 48 and 47 and are disposed in side walls 2 and 3 respectively. In order to prevent excessive tearing of side walls 2 and 3, expansion slits 56 and 57 are provided respectively with termination cuts 58 and 59 which are hook shaped and curve generally toward bottom wall 1 and terminate interiorly of the respective side walls 2 and 3.

Locking means for the carrier is provided in the form of locking tabs 60–63 which cooperate respectively in known manner with locking apertures 64–67. Also each locking tab 60–63 is provided with a heel portion h and a toe portion t. It will be understood that the invention may be applied to carriers in which locking tabs 60–63 and locking apertures 64–67 are omitted and in which the end flaps are secured together by some other means such as glue.

Figure 3:
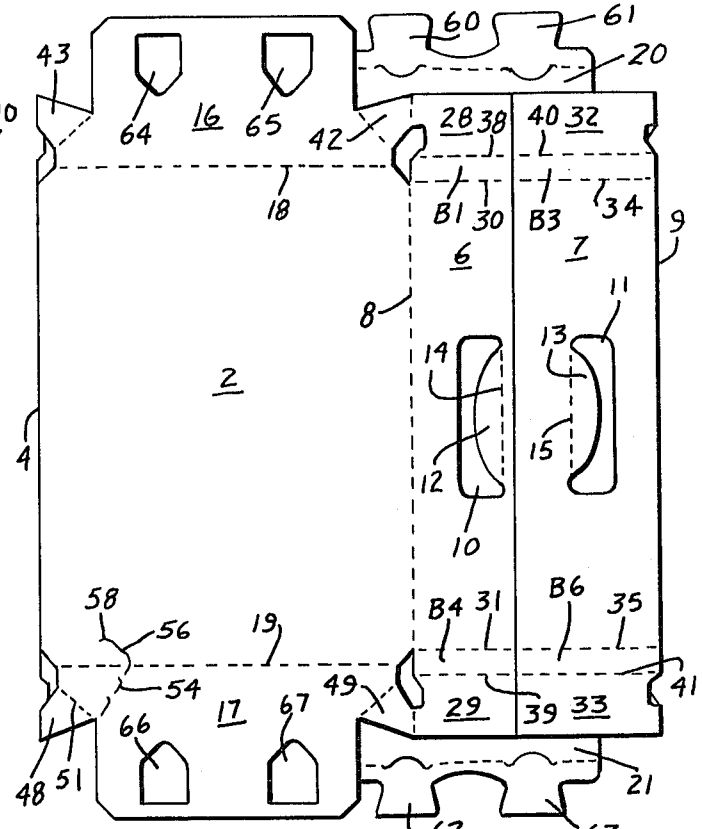
FIGS. 2 and 3 depict intermediate stages through which the blank is manipulated and glued in order to form a completed carrier as shown in FIG. 4.
Figure 2:
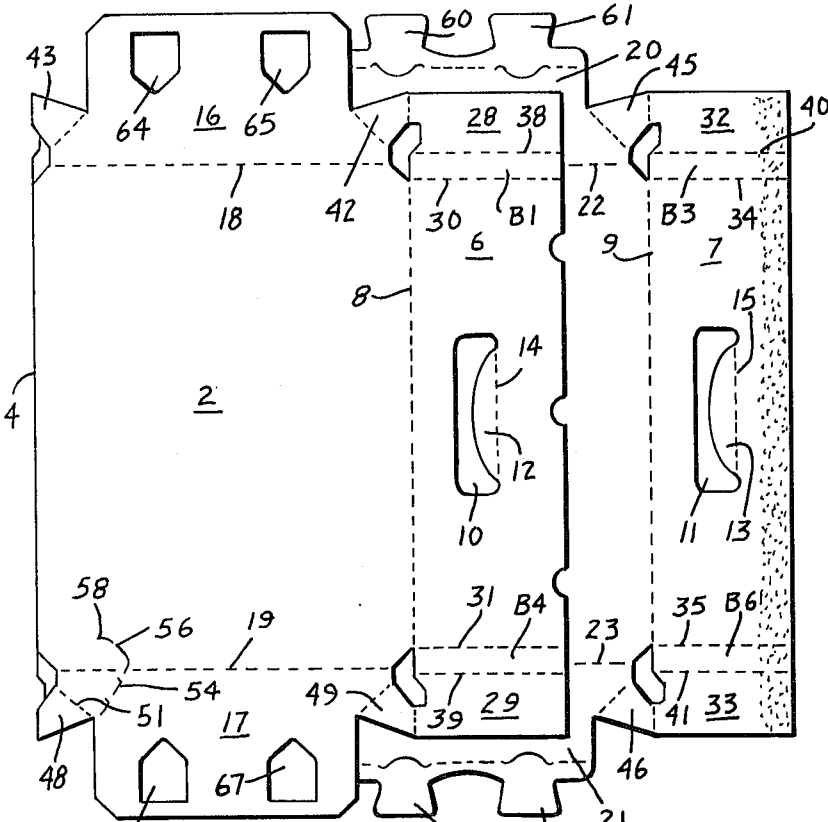

In order to form the carrier from the blank shown in FIG. 1, it is simply necessary to elevate and fold side wall 2 and top panel 6 over along fold line 4 into the positions shown in FIG. 2. Then an application of glue is made to top panel 7 and partial end panels 32 and 33 as shown by stippling in FIG. 2. These elements then are elevated and folded over along fold line 9 into the positions shown in FIG. 3. By this means top panel 7 and partial end flaps 32 and 33 are adhered respectively to top panel 6 and partial end flaps 28 and 29. Side walls 2 and 3 are expanded by the packages to positions perpendicular to bottom wall 1 and top wall 6, 7.

Following this the carrier is loaded with the desired contents and then end flaps 24, 25, 28, 29, 32 and 33 are folded inwardly of the carrier. Following this end flaps 16, 17, 20 and 21 are folded inwardly and locked into position by means of locking tabs 60–63 and locking apertures 64–67 as explained, the carrier could also be secured in a closed condition by means of glue as is well known.

Figure 5:
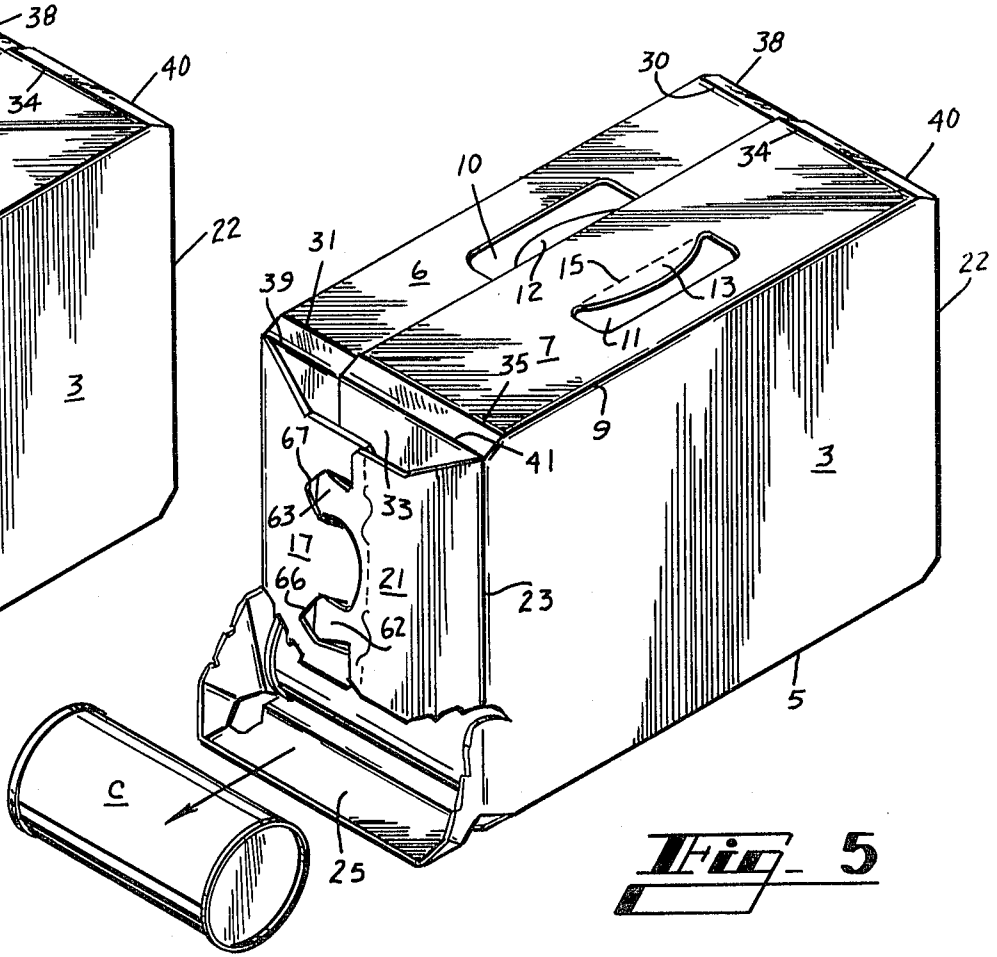
FIG. 5 is an isometric view of an erected carrier showing the operation of the dispensing feature.
Figure 4:
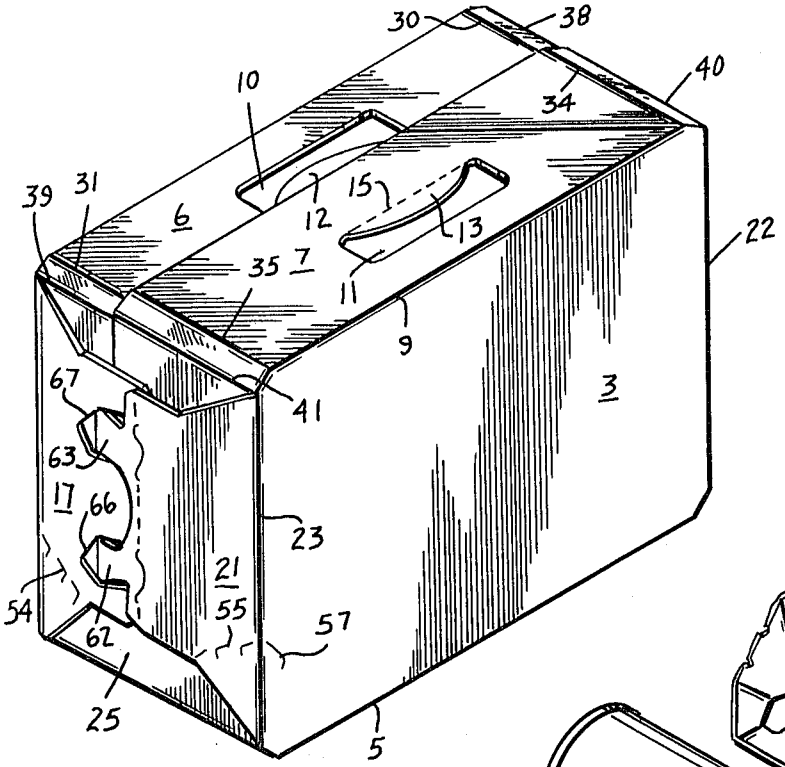

In order to utilize the dispensing function formed according to this invention, it is simply necessary to manually tear end flaps 17 and 21 along tear lines 54 and 55 respectively. Thereafter end flap 25 is lowered into the position shown in FIG. 5. Then in order to remove the contents of the carrier such as can C, it is simply necessary to grasp the ends of can C and remove it from the carrier. In order conveniently to grasp can C around the ends thereof, expansion slits 56 and 57 are provided and allow sufficient space for the user's fingers to occupy positions between the ends of cans C and side walls 2 and 3. In order to render the dispensing feature reusable it is simply necessary to elevate end flap 25 upwardly along fold line 27 and to tuck end flap 25 underneath the lower portions of end panels 17 and 21. In this manner an accidental discharge of cans C is prevented since end flap 25 is in effect locked in place.

INDUSTRIAL APPLICABILITY

By this invention a fully enclosed article carrier is provided with a dispensing feature which is both convenient and reusable.

We claim:

1. An article carrier comprising a bottom wall, a pair of side walls joined respectively to the side edges of said bottom wall and extending upwardly therefrom, a top wall joined along the side edges thereof respectively to the upper edges of said side walls, a pair of end flaps foldably joined respectively to the ends of said side walls at one end of the carrier, another end flap foldably joined to the end of said bottom wall at said one end of the carrier, a web panel interconnecting each end of said another end flap and the adjacent one of said pair of end flaps, a pair of tear lines formed respectively in said pair of end flaps and extending respectively from the junctions between said pair of end flaps and the associated side wall and terminating respectively along the edges of said pair of end flaps substantially adjacent said web panels, and a pair of expansion slits formed respectively in said side walls and comprising extensions of said tear lines, said expansion slits terminating respectively interiorly of said side walls.

2. An article carrier according to claim 1 wherein said web panels are joined to said pair of end flaps along fold lines and wherein said tear lines terminate respectively in coincidence with the ends of said fold lines remote from said junctions.

3. An article carrier according to claim 1 wherein a pair of termination cuts are formed respectively in said side walls and comprise extensions of said expansion slits respectively.

4. An article carrier according to claim 3 wherein said termination cuts are hook shaped.

* * * * *